US006637745B1

(12) United States Patent
Vardanyan

(10) Patent No.: US 6,637,745 B1
(45) Date of Patent: Oct. 28, 2003

(54) PYRAMID PUZZLE SYSTEM

(76) Inventor: Gevorg Vardanyan, 412 N. Jackson St., #101, Glendale, CA (US) 91206

( * ) Notice: Subject to any disclaimer, the term of this patent is extended or adjusted under 35 U.S.C. 154(b) by 0 days.

(21) Appl. No.: 10/051,687

(22) Filed: Jan. 22, 2002

(51) Int. Cl.[7] ..... A63F 9/12
(52) U.S. Cl. ..... 273/153 P; 273/153 R
(58) Field of Search ..... 273/156, 153 P, 273/153 R; 434/236, 211

(56) References Cited

U.S. PATENT DOCUMENTS 3,837,652 A * 9/1974 Kuwagaki et al. ..... 273/157 R
3,945,645 A * 3/1976 Roberts ..... 273/157 R
4,060,247 A * 11/1977 Kobres, Jr. ..... 273/157 R
4,988,103 A * 1/1991 Cheng ..... 273/157 R
5,988,640 A * 11/1999 Wheeler ..... 273/24

* cited by examiner 1

*Primary Examiner*—Kien T. Nguyen
(74) *Attorney, Agent, or Firm*—J. E. McTaggart

(57) ABSTRACT

A system of pyramid puzzles provides sets of puzzle-pieces formed as identical spheres tangentially attached together in one or more row(s) on a square grid pattern, configured to provide interesting challenges with surprising solutions in assembling pyramids The puzzle system includes two families of sets of matched pairs of puzzle pieces for assembling pyramids of two corresponding equilateral shapes: triangle-based and square-based. For the triangular-based pyramid, puzzle-pieces are configured from single or plural attached rows of spheres forming rectangular outlines that each form an inclined layer in the pyramid. For the square-based pyramid, puzzle-pieces are configured in generally L-shaped orthogonal forms in matched pairs that each combine to form a horizontal layer in the pyramid. The sets can range from relatively simple with as few as four puzzle-pieces to larger sets of any desired size, increasing in progressive steps, in accordance with the teachings of the invention.

18 Claims, 5 Drawing Sheets

PYRAMID PUZZLE SYSTEM

FIELD OF THE INVENTION

The present invention relates to the field of puzzles for educational and entertainment purposes, and more particularly it relates to a system of manual assembly puzzles wherein a set of puzzle-pieces, formed from rows of tangentially-attached spheres, can be assembled in a special non-apparent manner to form a pyramid.

BACKGROUND OF THE INVENTION

The pyramid as a geometric form has remained a source of fascination to mathematicians, historians and the general public alike for many centuries. The square-based pyramids built by the ancient Egyptians for royal tombs continue to grip the public imagination among the wonders of the world: historical man-made structures that remain mysterious despite scientific studies that have revealed extraordinary accomplishment in their concept, design and construction, based on mystic "golden rules" of the pyramid.

Assembling a pyramid from puzzle-pieces presents an intellectual challenge that appeals to mentally active persons of all ages whether pursued for education or simply for relaxation.

For children especially, manual assembly games and puzzles requiring hand/eye/brain co-ordination and offering a satisfying reward for their successful solution, as in the pyramid puzzles of the present invention, can contribute strongly to beneficial overall development, and have much to offer in learning and entertainment.

DISCUSSION OF KNOWN ART

Many known types of manipulative puzzles have been confined to a two-dimensional end result, e.g. the conventional jig-saw puzzle. Going beyond into the third dimension has yielded approaches that utilize puzzle-pieces as building block elements in various complex shapes that could be considered analogous to a three-dimensional jig saw puzzle, with the elements ranging from the well-known children's cubic blocks to other polyhedrons, i.e. flat-faced solid forms.

The sphere has a long history of individual usage in toys such as balls and marbles, but is not commonly found tangentially-attached in puzzle-pieces in rows or two-dimensional arrays for assembling a three-dimensional object such as pyramid.

U.S. Pat. No. 2,216,915 is of interest in disclosing a puzzle wherein a solid equilateral tetrahedral pyramid is divided into two identical solid pentahedral halves at a square interface.

U.S. Pat No. 3,945,645 utilizes tangential spheres to construct a tetrahedral pyramid with 5 spheres per edge from nine assembly pieces: eight triangular arrays and one square array.

U.S. Pat No. 5,108,100 utilizes pieces of various shapes strung is together like beads with a flexible cord.

U.S. Pat No. 3,837,652 utilizes spheres with connecting axes to construct a pentahedral pyramid from a variety of puzzle-pieces utilizing spheres adjoined at various angles including 60 degrees and 120 degrees.

Other approaches have included non-uniform sphere sizes, non-orthogonal relationship, and complex three-dimensional clusters of irregular shapes.

OBJECTS OF THE INVENTION

It is a primary object of the present invention to provide a system of puzzles wherein puzzle-pieces fashioned from single and multiple rows of identical attached elements can be manually assembled in a special puzzling non-apparent procedure to form an pyramid, i.e. one with all edges equal in length such that all triangular faces are equilateral.

It is a further object to provide strategically selected sets of such puzzle-pieces configured in the form of simple two-dimensional orthogonal shapes which do not suggest any relationship to a pyramid, but instead present an intellectual puzzle-solving challenge requiring considerable imaginative effort to solve since the unique solution is non-apparent, unexpected and seemingly devious.

It is a further object to form the shape of the puzzle-pieces by arranging the attached elements in one or more rows to form an orthogonal outline including that of a single row, plural attached rows forming a rectangle or L-shape, or other orthogonal shape.

It is a further objective that the puzzle-pieces be formed with the elements located orthogonal to each other and thus aligned in one or more straight rows with the element locations co-ordinated on a square grid pattern.

It is a further object of the invention to provide, as a first main embodiment, a family of puzzle sets wherein the puzzle-pieces of each set are configured such that they can be combined to form an "triangle-based" pyramid, which for purposes of this disclosure should be understood to refer to an equilateral tetrahedron, i.e. having four identical equilateral triangular faces and six equal edges.

It is a further object of the invention to provide, as a second main embodiment, a family of puzzle sets wherein the puzzle-pieces of each set are configured such that they can be combined to form a "square-based" pyramid, which refers to an equilateral pentahedron, i.e. having five faces including one square bottom face. four identical equilateral triangular faces, and eight equal edges.

It is a further object to provide systematic methods of expanding sets of both families to enable assembly of larger pyramids with increased quantities of elements and puzzle-pieces.

SUMMARY OF THE INVENTION

The foregoing objects have been met in the present invention which provides a system of pyramid puzzle sets wherein the elements that form the puzzle-pieces are configured as identical spheres tangentially attached together in one or more rows on a square grid pattern. The system includes the two families of strategically selected sets of puzzle-pieces for both types of pyramids in various sizes.

In preferred embodiments, a puzzle-pieces in a set are configured as a plurality of matched pairs in which the two puzzle-pieces are made identical with each other.

In the family of puzzle sets directed to the triangle-based type of pyramid as defined above, the puzzle-pieces in a set are provided in matched pairs which include typically one matched pair of puzzle-pieces, each having spheres arranged and joined tangentially in a single row, and one (or a series of) additional matched pair(s) of rectangular puzzle-pieces each with spheres arranged orthogonally and joined tangentially in plural rows forming a two-dimensional rectangular-shaped matrix of spheres that each form a layer in the assembly of the pyramid.

In the family of puzzle sets directed to the square-based type of pyramid as defined above: the puzzle-pieces in a set are provided in matched pairs and are configured from identical spheres arranged and attached to form shapes such as single rows, rectangles, L-shapes and other orthogonal shapes.

In both families, the sets can range from relatively simple with as few as four puzzle-pieces with two matched pairs to progressively larger sets for pyramids of any desired size as formulated in accordance with the teachings of the invention.

BRIEF DESCRIPTION OF THE DRAWINGS

The above and further objects, features and advantages of the present invention will be more fully understood from the following description taken with the accompanying drawings in which.

DETAILED DESCRIPTION

Figure 1A:
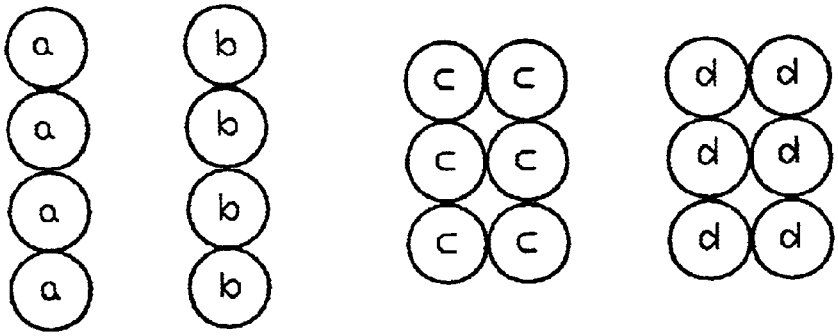
FIG. 1A shows a set of four puzzle-pieces that can be combined to form a pyramid of the triangle-based type.

FIG. 1A shows a puzzle set of four simple puzzle-pieces, in two matched pairs with a total of twenty spheres, that can be combined to form a triangle-based pyramid having four spheres along each of its six edges. The four spheres in the first single row, which can be regarded as a 1×4 matrix array, are identified as "a" and the four spheres in the other piece of the pair are identified as "b". The six spheres in the first 2×3 array are identified as "c" and the six spheres in the second 2×3 array are identified as "d".

Figure 1B:
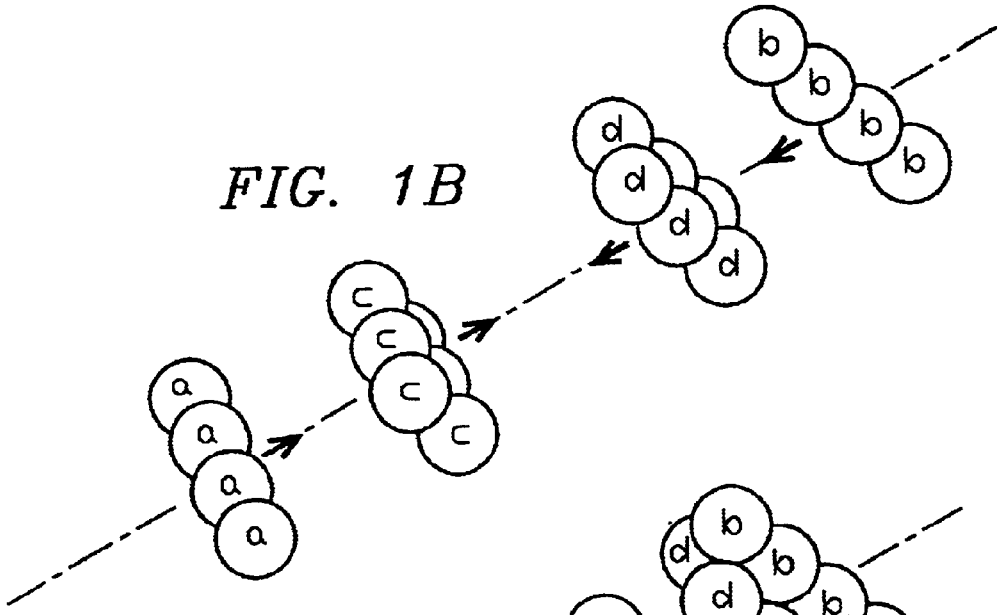
FIGS. 1B and 1C depict two steps in aligning and combining the puzzle-pieces of FIG. 1A to form the pyramid.

FIG. 1B depicts the four puzzle-pieces of FIG. 1A rearranged and aligned for assembling the pyramid.

Figure 1C:
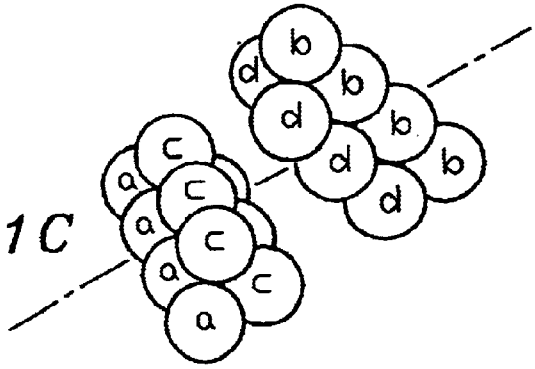

In FIG. 1C the "a" puzzle-piece is shown merged with the "c" puzzle-piece and the "b" puzzle-piece is shown merged with the "d" puzzle-piece to form two clusters that are identical except for orientation, being located in mirror-symmetry and rotated 90 degrees from each other about the central axis shown.

Figure 1D:
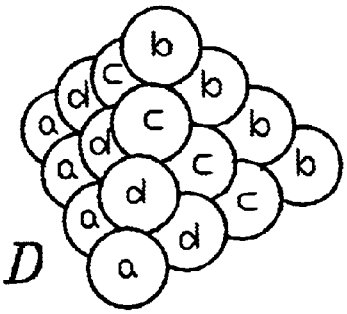
FIG. 1D is a three-dimensional view of the pyramid assembled from the two clusters shown in FIG. 1C showing the puzzle-piece locations.

FIG. 1D is a three-dimensional view of the triangle-based pyramid assembled from the puzzle-pieces of FIG. 1A by merging the two clusters of FIG. 1C. The locations of the puzzle-pieces in the pyramid are indicated by the letter shown on the visible spheres.

Figure 1E:
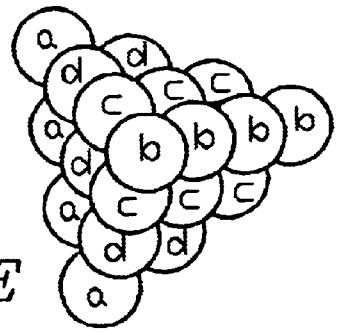
FIG. 1E is a top view of the pyramid of FIG. 1D showing the puzzle-piece locations.

FIG. 1E is a top view of the pyramid of FIG. 1D, similarly indicating the puzzle-piece locations.

Figure 2A:
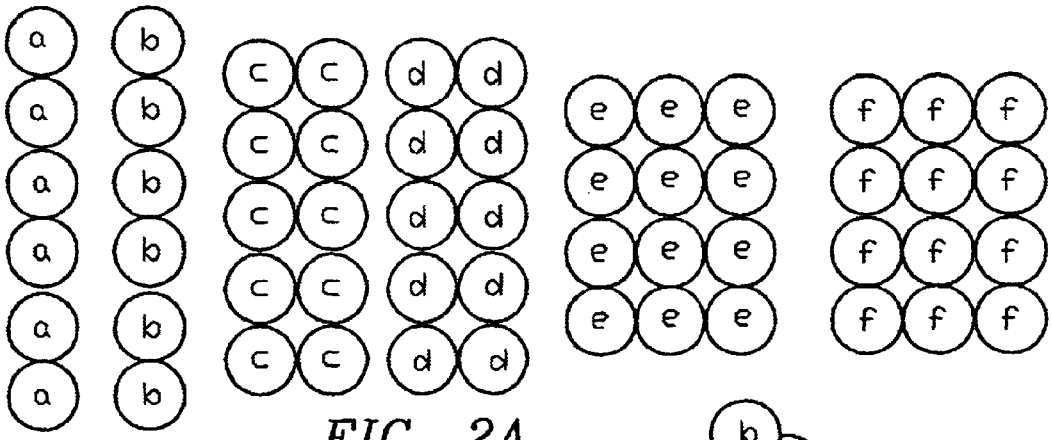
FIG. 2A shows a set of six puzzle-pieces that can be combined to form a triangle-based pyramid.

FIG. 2A shows a set of six puzzle-pieces, in three matched pairs with a total of 56 spheres, that can be combined to form a pyramid of the triangle-based type having six spheres along each of the four edges. The six spheres in each of the 1×6 arrays are identified as "a" and "b", The ten spheres in each of the 2×5 arrays are identified as "c" and "d". The twelve spheres in each of 3×4 rag arrays are identified as "e" and "f".

Figure 2B:
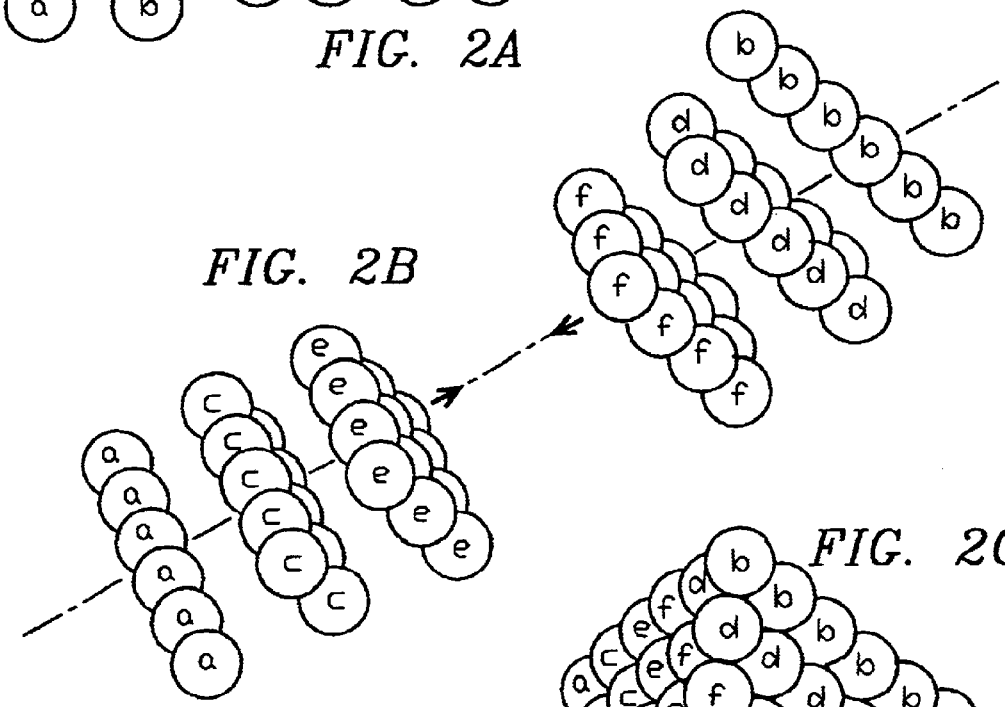
FIG. 2B shows a three-dimensional view of the puzzle-pieces of FIG. 2A rearranged in an initial alignment for assembly of the pyramid.

FIG. 2B shows the puzzle-pieces of FIG. 2A arranged and aligned for assembly of the triangle-based pyramid. At this point they could be merged into two or three clusters or simply all merged together FIG. 2C is a three-dimensional view of the pyramid assembled by merging the puzzle-pieces aligned as in FIG. 2B, with the locations of the puzzle-pieces indicated by the letter on the visible spheres.

Figure 2C:
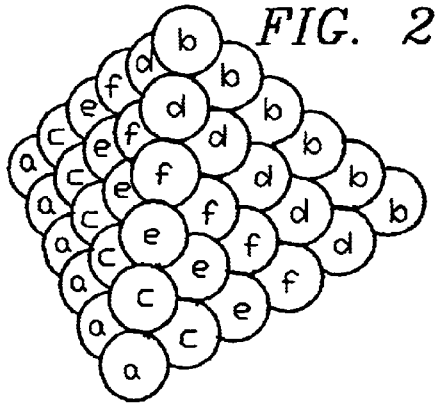
FIG. 2C is a three-dimensional view of the pyramid assembled from the puzzle-pieces aligned as in FIG. 2B, showing the puzzle-piece locations.
Figure 2D:
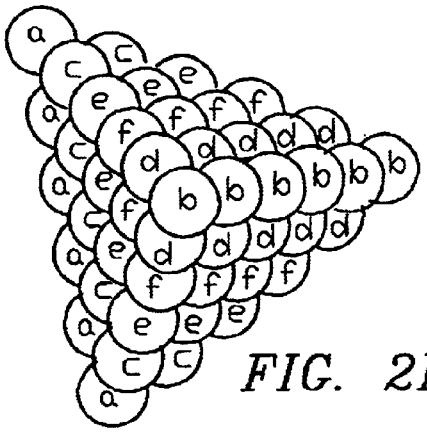
FIG. 2D is a top view of the pyramid of FIG. 2C showing the puzzle-piece locations.

FIG. 2D is a top view of the pyramid of FIG. 2C, similarly indicating the puzzle-piece locations.

The above described methods of constructing a triangle-based pyramid from a set of rectangular puzzle-pieces in matched pairs is based on special properties of this type of pyramid that are obscure and surprising to most of the general public. There are four faces and six edges including three non-intersecting pairs of opposite edges. Midway between any one of these three pairs the pyramid can be divided into two identical halves at a central plane that forms a square interfacing surface on each half-pyramid. Except for a 90 degree relative rotation about a central axis, shown in FIGS. 1B, 1C and 2B, the two half-pyramids are mirror-symmetrical, thus allowing the pyramid to be constructed from matched pairs of puzzle-pieces, each forming a rectangular layer in a progressive series of matrix arrays that extends between the two opposite edges.

With four spheres per edge as in FIG. 1B, the matrix array progression is 1×4,2×3,3×2,4×1 in the set of 2 matched pairs containing total of 20 spheres.

Similarly with six spheres per edge as in FIG. 2B the progression is 1×6,2×5,3×4,4×3, 5×2, 6×1. (3 pairs, 56 spheres)

The progression can be expressed for any even number N spheres per edge:

$$1\times N,\ 2\times(N-1),\ 3\times(N-2)\ \ldots\ (N/2\times(N/2)+1),\ ((N/2)+1)\times(N/2)\ \ldots\ (N-2)\times 3,\ (N-1)\times 2,\ N\times 1$$

Each member in the series is a matrix of spheres forming a rectangular layer in the pyramid. There are a total of N layers in a stack extending between the two opposite edges.

Making each layer from one puzzle-piece, there will be N puzzle-pieces, i.e. N/2 matched pairs, and the rectangular shape of each of the puzzle-pieces in each half of the pyramid can be defined by the matrix series:

$$1\times N,\ 2\times(N-1),\ 3\times(N-2)\ \ldots\ (N/2)\times((N/2)+1)$$

From the foregoing matrix series, the dimensions of the rectangular layers in each identical half of the pyramid, from the edge to the central plane, and the total number of spheres in this type of pyramid can be tabulated as a function of N:

TABLE I

Triangle-based pyramid:

| N | Matrix series for half-pyramid | Total spheres in pyramid |
|---|---|---|
| 2 | 2 × 1 | 4 |
| 4 | 4 × 1, 3 × 2 | 20 |
| 6 | 6 × 1, 5 × 2, 4 × 3 | 56 |
| 8 | 8 × 1, 7 × 2, 6 × 3, 5 × 4 | 120 |
| 10 | 10 × 1, 9 × 2, 8 × 3, 7 × 4, 6 × 5 | 220 |
| etc. | | |

TABLE I confirms the previous showing that the rectangular shape of the two interfacing puzzle-pieces at the center of the pyramid can be expressed as (N/2)×((N/2)+1) spheres. For large values of N, this rectangular shape approaches the square shape of the geometric interface in the central plane of symmetry of the pyramid. The aspect ratio (height/width of rectangle) is seen to decrease progressively from N to 1 from edge to center.

With N/2 layers in each identical half-pyramid, starting with N spheres in a row along an edge as the first layer, for each successive layer the number of spheres per row decreases by one and the number of rows increases by one. A minimal quantity of puzzle-pieces is accomplished by making each layer a single puzzle-piece. For keeping the puzzle-pieces in matched pairs with no empty matrix cells, N is kept an even number. Odd values of N would require a single square N×N puzzle-piece as the central layer: having an odd number of spheres, cannot be divided into identical halves without is leaving one or more matrix cells empty.

Figure 3A:
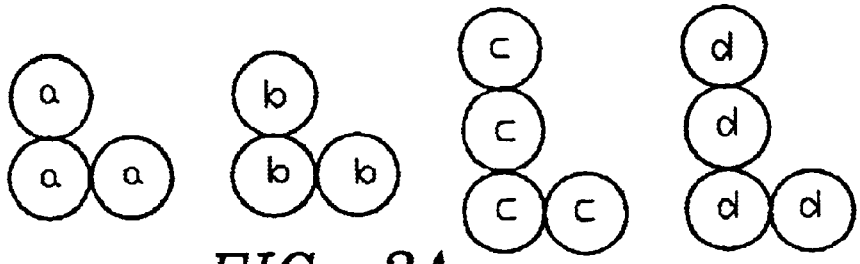
FIG. 3A shows four puzzle-pieces which can be combined to form a 3×3 square-based pyramid.

FIG. 3A shows a set of four puzzle-pieces in two matched pairs configured in the two L-shapes shown, with spheres identified as a,b c,d; this set can be combined to form a 3×3 square-based pyramid.

Figure 3B:
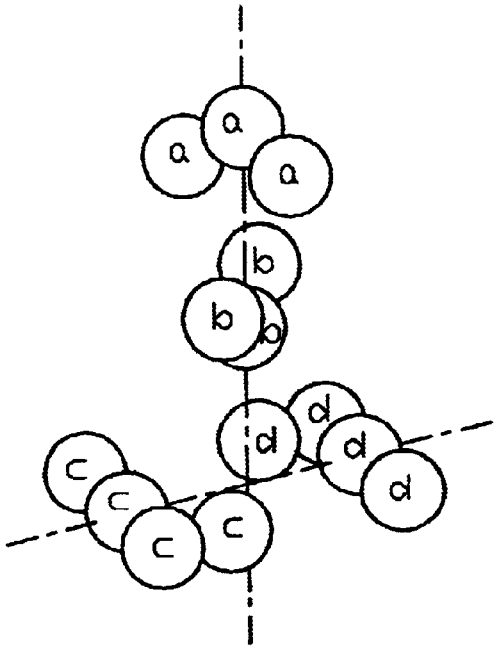
FIG. 3B depicts the puzzle-pieces of FIG. 3A rearranged in a preliminary alignment for assembling the pyramid.

FIG. 3B shows the puzzle-pieces of FIG. 3A arranged and aligned on two axes for assembly of the pyramid.

Figure 3C:
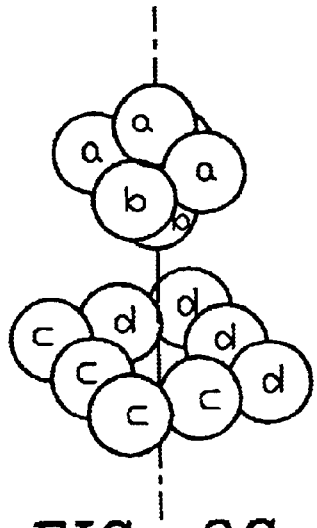
FIG. 3C show two clusters formed from merging the puzzle-pieces as aligned in FIG. 3B.

FIG. 3C shows the puzzle-pieces with the six a and b spheres in the two matched puzzle-pieces with a and b spheres merged together, and shows the other two matched puzzle-pieces with c and d spheres merged together.

The six merged a and b spheres merged form a cluster shaped as a cube that is essentially symmetrical on all three axes through opposite spheres. The six spheres correspond to the six faces on a cube, so that in any of six different orientations of the cube, it provides a 2×2 square layer along with a central sphere on top and a central sphere beneath.

The eight merged c and d spheres form a cluster shaped as a 3×3 square in a single layer with an empty cell at center as shown.

Figure 3D:
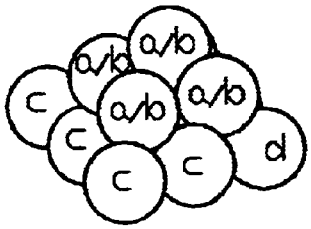
FIG. 3D is a three-dimensional view the pyramid assembled from the two clusters shown in FIG. 3C, showing the puzzle-piece locations.

FIG. 3D is a three-dimensional view of the pyramid resulting from merging the two clusters of FIG. 3C. The empty cell of the 3×3 square receives the bottom central sphere of the six-sphere cluster and thus becomes a full 3×3 matrix forming the base layer of the pyramid. The six-sphere cluster provides the 2×2 matrix forming the second layer as well as providing, as the pyramid apex, the single central sphere, which may be regarded as 1×1 in the matrix series. The spheres of the six-sphere cluster are identified in FIGS. 3D and 3E as "a/b" in recognition of the six possible orientations of this cluster described above.

This method of assembly utilizing the six-sphere cubic cluster in co-operation with the eight-sphere square cluster configured with an empty cell to form the top three layers of a pyramid is a special feature of the invention that allows the puzzle-piece sets for square-based pyramids to meet the requirement of keeping all the puzzle-pieces in matched pairs, each piece made in a two-dimensional shape from two or more attached spheres, in accordance with a main objective of the invention. This method is both serendipitous and synergistic, solving two problems that would occur otherwise: it avoids a requirement for a single sphere at the top of the pyramid and also, in the 3×3 layer, it serves to fill the central cell that results from the requirement of keeping the puzzle-pieces in matched pairs.

Figure 3E:
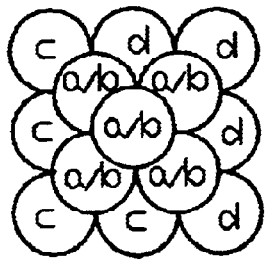
FIG. 3E is a top view of the pyramid of FIG. 3E, showing the puzzle-piece locations.

FIG. 3E is a top view of the pyramid shown in FIG. 3D, similarly indicating the puzzle-piece locations.

Figure 4A:
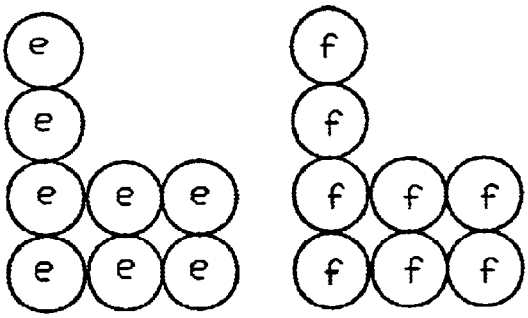
FIG. 4A shows an matched pair of puzzle-pieces that can be added to those of FIG. 3A to form a larger set that can be combined to form a 4×4 square-based pyramid.
Figure 4B:
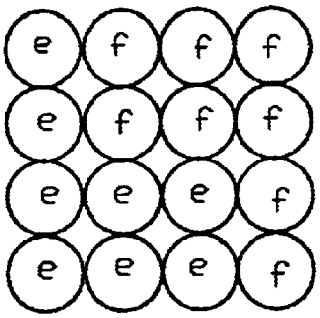
FIG. 4B shows the 4×4 square layer, formed from the puzzle-pieces of FIG. 4A, which can form the base of a 4×4 square-based pyramid.

FIG. 4A shows an matched pair of L-shaped puzzle-pieces that can be combined to form the 4×4 square layer shown in FIG. 4B, and which can be added as a base layer merged beneath the square-based pyramid of FIGS. 3E and 3F to enlarge the size of the pyramid by one layer, i.e. one sphere per edge.

Figure 5A:
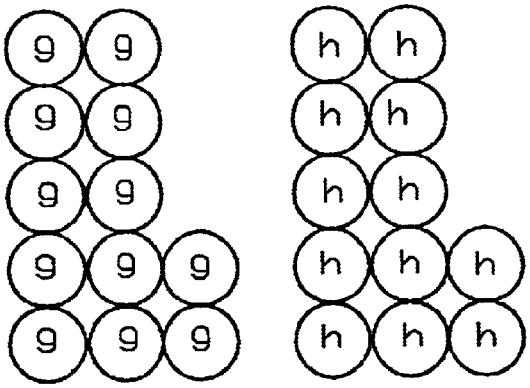
FIG. 5A shows an matched pair of puzzle-pieces that can be added to those of FIG. 3A and FIG. 4A to form a larger set that can be combined to form a 5×5 square-based pyramid.
Figure 5B:
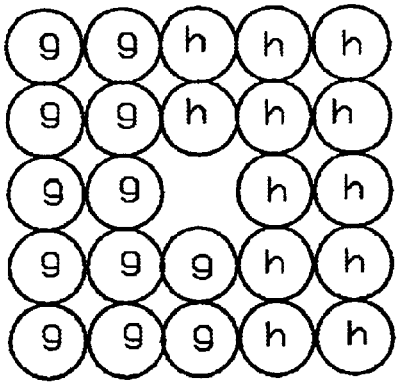
FIG. 5B shows the 5×5 square layer, formed from the puzzle-pieces of FIG. 5A, that can form the base of a 5×5 square-based pyramid.

FIG. 5A shows an matched pair of L-shaped puzzle-pieces that can be combined to form the 5×5 square base shown in FIG. 5B, and which can be merged beneath the 4×4 layer shown FIG. 4B and the 3×3 pyramid of FIGS. 3E and 3F, to further enlarge the base size of the pyramid by one sphere per side. The empty cell at the center enables the two puzzle-pieces to be made identical for layers that have an odd number of spheres per side.

Figure 6A:
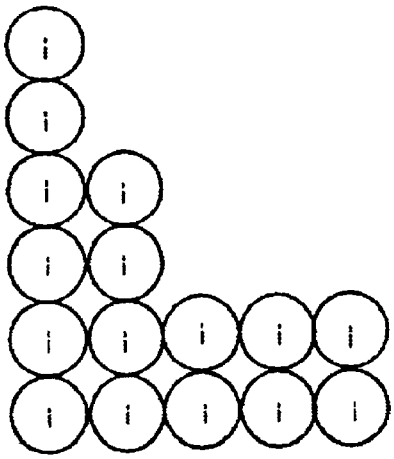
FIG. 6A shows a one of a matched pair of puzzle-pieces that can be added to those of FIGS. 3A–5A to form a larger set that can be combined to form a 6×6 square-based pyramid.
Figure 6B:
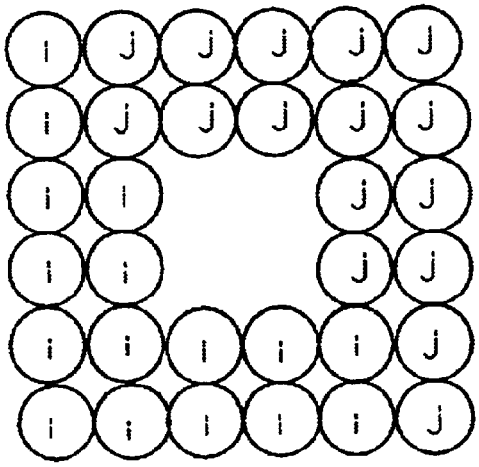
FIG. 6B shows the 6×6 square layer formed from the puzzle-pieces of FIG. 6A.

FIG. 6A shows one of an matched pair of L-shaped puzzle-pieces that can be combined to form the 6×6 square layer shown in FIG. 6B, and which can be combined beneath the 5×5 square base of a pyramid formed as described in connection with FIG. 5B to further enlarge the base size of the pyramid by one sphere per side.

The four empty cells seen at the center of square layer 6B are optional for even values of spheres; these central empty cells can be utilized in conjunction with the central empty cell in FIG. 5B to serve as a vault in the pyramid, where a special puzzle-piece or cluster may be provided as a novelty occupant of the vault.

Figure 7A:
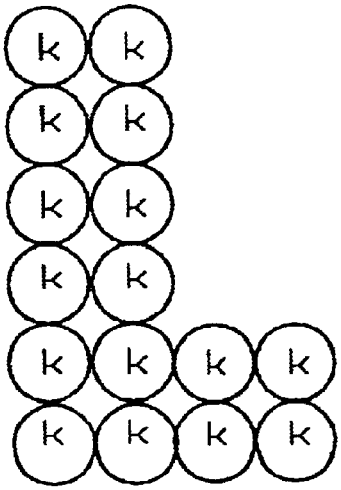
FIG. 7A shows one of a pair of puzzle-pieces as an alternative to that of FIG. 6A for forming a 6×6 square layer.
Figure 7B:
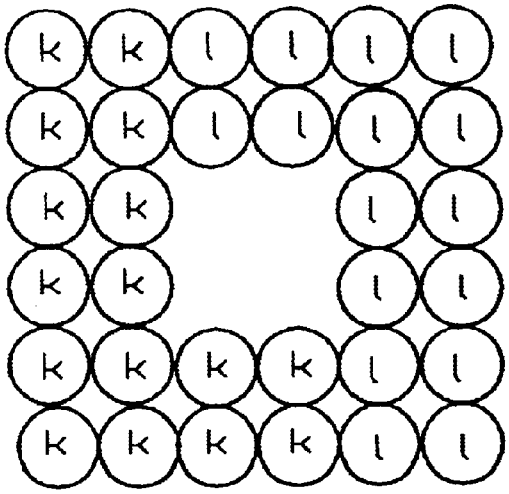
FIG. 7B shows the 6×6 square layer, as in FIG. 6B, formed from the puzzle-pieces of FIG. 7A

FIG. 7A shows one of an matched pair of puzzle-pieces having an L-shape that is an alternative to that in FIG. 6A for forming a 6×6 square layer as shown in FIG. 7B with the puzzle-pieces identified.

Figure 8A:
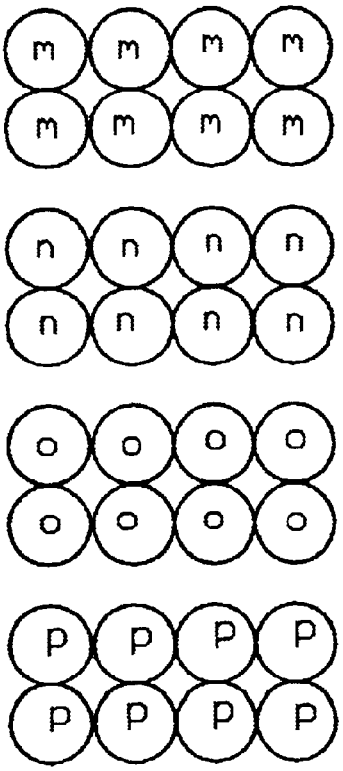
FIG. 8A shows four matched rectangular puzzle-pieces for forming a 6×6 square layer.
Figure 8B:
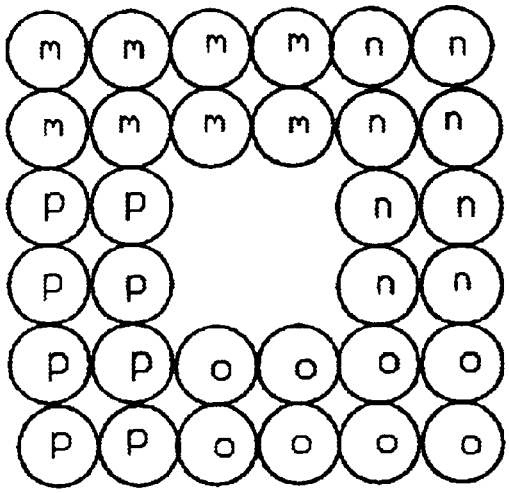
FIG. 8B shows the 6×6 square layer, as in FIGS. 6B and 7B formed from the four puzzle-pieces of FIG. 8A

FIG. 8A shows four identical rectangular puzzle-pieces as another alternative for forming a 6×6 square layer as shown in FIG. 8B with the puzzle-pieces identified.

By continuing to add larger layers at the bottom as describe above, the pyramid can be enlarged to any desired size. For purposes of the present invention, each layer is divided into two identical puzzle-pieces using any available pattern that keeps the two halves identical. The number of such patterns available increases with the size of the square layer.

As an option the larger layers can be divided into four or more identical puzzle-pieces. Furthermore, a large number of different puzzle-piece shapes can be made available by not requiring pairs of puzzle-pieces to be matched, and by dividing the square layer into any odd or even number of puzzle-pieces.

For square based pyramids with N spheres per side, and thus a total of N layers edge-to-edge, the series of square matrix layers and total number of spheres, assuming no empty cells, are tabulated in TABLE II as follows:

TABLE II

Square-based pyramid layers/puzzle-piece pairs:

| N | Matrix Series | Total number of spheres in pyramid |
|---|---|---|
| 2 | 1x1, 2x2 | 5 |
| 3 | 1x1, 2x2, 3x3 | 14 |
| 4 | 1x1, 2x2, 3x3, 4x4 | 30 |
| 5 | 1x1, 2x2, 3x3, 4x4, 5x5 | 55 |
| 6 | 1x1, 2x2, 3x3, 4x4, 5x5, 6x6 | 91 |
| etc. | | |

The spheres may be made from any suitable material such as metal, plastic, wood, glass, stone or ivory. They may be colored in a special manner or left natural. They may be molded in a manner to be already attached in a row, multiple rows or other puzzle-piece patterns, or joined together by drilling and inserting friction dowels or other fasteners.

The spheres may be tightly spaced as shown, or they can be spaced slightly apart with a small rod or dowel.

While the preferred embodiment utilizes spheres with smooth surfaces, the invention can be practiced with shapes other than spherical and surfaces other than smooth. For example, the "spheres" may be made with flat facets, and these may be made to correspond with potential points of contact with other "spheres".

Practice of the invention could include magnetizing the puzzle-pieces in a manner to assist in retaining them in assembled condition.

The requirement for all puzzle-pieces of set to be in matched pairs is a preferred standard that would not be essential for the: practice of the invention according to other criteria.

Although the preferred embodiments shown conform to the desired standard of providing each set of puzzle-pieces in a minimum quantity of matched pairs available for the particular type and size of pyramid of puzzle-pieces, further versions of the embodiments shown can be implemented by starting with a number of basic puzzle-patterns then subdividing one or more of these patterns into two or more puzzle-pieces and providing the balance of the patterns as puzzle-pieces.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A pyramid puzzle, providing a challenge to assemble a three-dimensional pyramid from puzzle-pieces formed from uniform tangentially-attached spheres, comprising:

a set consisting of a plurality of like pairs of puzzle-pieces, each puzzle-piece comprising at least one row of spheres, at least half of the puzzle-pieces being two-dimensional, i.e. comprising at least one additional row containing at least one sphere, each sphere in each puzzle piece being tangentially attached to each adjacent sphere in the puzzle piece, all spheres in each puzzle-piece being located so as to be co-ordinated on a square grid pattern in a common plane, the set being made and arranged to form a three-dimensional pyramid shape when assembled together manually according to a predetermined procedure.

2. The pyramid puzzle as defined in claim 1 wherein the set of puzzle-pieces consists of a plurality of pairs of key puzzle-pieces formed from the spheres, wherein, in each pair, the puzzle-pieces are shaped substantially identical to each other.

3. The pyramid puzzle as defined in claim 2 wherein the pyramid is square-based, having a square bottom face and four substantially identical triangular faces.

4. The pyramid puzzle as defined in claim 3 comprising;

an matched pair of first puzzle-pieces each consisting of two spheres attached to the third and extending therefrom perpendicular to each other, forming an equilateral L shape such that the pair of the first puzzle-pieces can be combined to form a cluster that provides a single central top sphere constituting a top layer of the pyramid, a 2×2 square layer, providing second layer down from the top of the pyramid, and a single sphere extending downwardly from a central location of the 2×2 square layer; and an matched pair of second puzzle-pieces each consisting of four spheres, three thereof attached in a row and one extending perpendicularly from an end one of the row to form an L shape such that the pair of second puzzle-pieces can be combined to form a 3×3 square shape with a central empty cell, which can be further combined with the cluster formed by the pair of the first puzzle-pieces to form a 3×3 square-based pyramid.

5. The pyramid puzzle as defined in claim 4 wherein each identical subset of puzzle-pieces further comprises;

a fourth puzzle-piece consisting of eight tangentially-attached spheres arranged in an L shape configured as three adjacent rows of four, two and two spheres respectively, such that two of the fourth puzzle-pieces, one from each subset, can be combined to form a 4×4 square layer, which in turn can be combined as an enlarged base layer under a 3×3 pyramid formed from two each of the first and second puzzle-pieces, so as to thus form a 4×4 square-based pyramid.

6. The pyramid puzzle as defined in claim 5 wherein each identical subset of puzzle-pieces comprises:

a fifth puzzle-pieces containing 12 tangentially-attached spheres arranged in an L shape configured as three adjacent rows of five, five and two spheres respectively, such that two of the fifth puzzle-pieces, one from each subset, can be combined to form a 5×5 square layer, with a central empty cell, which in turn can be combined as an enlarged base under a 4×4 pyramid formed from two each of the first, second and third puzzle-pieces, to thus form a 5×5 square-based pyramid.

7. The pyramid puzzle as defined in claim 6 wherein each identical subset of puzzle-pieces comprises:

a sixth puzzle-piece containing 32 tangentially-attached spheres arranged in an L shape configured as five adjacent rows of six, four, two, two and two respectively, such that two of the sixth puzzle-pieces, one from each subset, can be combined to form a 6×6 square layer, with four central empty cells, which in turn can be combined as an enlarged base under a 5×5 pyramid formed from two each of the first, second, third and fourth puzzle-pieces, to thus form a 6×6 square-based pyramid.

8. The pyramid puzzle as defined in claim 2 wherein the pyramid shape is triangle-based with four substantially identical equilateral triangular faces.

9. The pyramid puzzle as defined in claim 8 wherein the set of puzzle-pieces comprises:

a pair of puzzle-pieces each having four spheres in a linear row; and a pair of puzzle-pieces each having six spheres arranged in two rows of three spheres each.

10. The pyramid puzzle as defined in claim 8 wherein the set of puzzle-pieces comprises:

a pair of puzzle-pieces each having six spheres in a linear row;

a pair of puzzle-pieces each having ten spheres arranged in two rows of five spheres each; and a pair of puzzle-pieces each having twelve spheres arranged in three rows of four spheres each.

11. The pyramid puzzle as defined in claim 8 wherein the set of puzzle-pieces comprises:

a pair of puzzle-pieces each having eight spheres in a linear row;

a pair of puzzle-pieces each having fourteen spheres arranged in two rows of seven spheres per row;

a pair of puzzle-pieces each having eighteen spheres arranged in three rows of six spheres per row; and a pair of puzzle-pieces each-having twenty spheres arranged in four rows of five spheres per row.

12. The pyramid puzzle as defined in claim 8 wherein the set of puzzle-pieces comprises a quantity N of puzzle-pieces corresponding to N successive rectangular shaped layers in the pyramid extending from a first layer formed by a row of N spheres along a first edge of the pyramid to a last layer formed by a row of N spheres along a second and opposite edge of the pyramid, oriented perpendicular to and non-intersecting with the first edge, the puzzle-pieces having rectangular shapes forming a geometric series of N matrix terms as follows: 1×N, 2×(N−1), 3×(N−2) . . . (N−2)×3, (N−1 )×2, N×1.

13. The pyramid puzzle as defined in claim 8 wherein the set of puzzle-pieces comprises a quantity of N puzzle-pieces made up from two identical subsets each having N/2 puzzle-pieces and each forming a geometric series of rectangular matrices of spheres located on a square grid pattern, starting with a linear row of N spheres, then, for each successive puzzle-piece in the series, decreasing the number of spheres per row by one and increasing the number of rows by one.

14. A pyramid puzzle system for configuring manipulative puzzles in sets formed from tangentially-attached substantially identical spheres made and arranged to form a set of puzzle-patterns from which a triangle-based equilateral pyramid with N spheres along each edge can be assembled in a challenging manner, the system comprising;

a two identical sets of puzzle-patterns each set comprising a quantity of N/2 rectangular matrices of adjacent spheres co-ordinated on a square grid pattern, in a series starting with matrix, 1×N, a single row of N spheres at one edge of the pyramid representing a first layer thereof, and 2×(N−1), two adjacent rows off N−1 spheres per row, then, for each successive term in the series, representing a successive layer in the pyramid, decreasing the number of spheres per row by one and increasing the number of adjacent rows by one, thus defining the puzzle-patterns as a series of rectangles with aspect ratios that decrease from N at the edge of the pyramid and approach 1 at a central plane of symmetry of the pyramid defining square-shaped interfacing-surfaces of two identical half-pyramids.

15. The pyramid puzzle system as defined in claim 14 wherein a puzzle embodiment thereof comprises a set of N puzzle-pieces, made up from two like sets of N/2 puzzle-pieces each configured in accordance with a corresponding one of the puzzle-patterns in the series.

16. The pyramid puzzle system as defined in claim 14 wherein a puzzle embodiment thereof comprises a set puzzle-pieces selected from a group including (a) partial-pattern puzzle-pieces which are formed from tangentially-attached spheres and shaped to combine with one or more other partial-pattern puzzle-pieces in a manner to constitute a corresponding one of the puzzle-patterns, and (b) puzzle-pieces that each represent a corresponding one of the puzzle-patterns.

17. A pyramid puzzle system for configuring manipulative puzzles that present a challenge to assemble a three-dimensional square-based pyramid from a set of strategically-shaped puzzle-pieces formed from tangentially-attached substantially identical spheres, made and arranged to be combined to form a three-dimensional cluster representing the pyramid from a series of N layers of spheres including:

a top layer comprising a single sphere;

a second layer, immediately beneath the top layer comprising four spheres in a 2×2 square array; and a plurality of successively larger layers each formed as a square array of spheres, each layer being enlarged by one sphere per side relative to a layer immediately above so as to form a geometric series of N terms as follows: 1×1, 2×2, 3×3 . . . N×N.

18. The pyramid puzzle system as defined in claim 17 wherein the first three layers at the top of the pyramid are formed from three matched pairs of puzzle-pieces and wherein each additional layer is formed from a matched pair of puzzle-pieces.

* * * * *